United States Patent [19]

Baker

[11] 4,309,932

[45] Jan. 12, 1982

[54] MUSIC PLAYING APPARATUS

[76] Inventor: James M. Baker, 1818 Hickory St., St. Louis, Mo. 63104

[21] Appl. No.: 170,287

[22] Filed: Jul. 18, 1980

[51] Int. Cl.[3] ..... G10F 1/00

[52] U.S. Cl. ..... 84/1.03; 84/DIG. 12

[58] Field of Search ..... 84/1.03, DIG. 12

[56] References Cited

U.S. PATENT DOCUMENTS

| | | | |
|---|---|---|---|
| 4,010,667 | 3/1977 | Kniepkamp | 84/DIG. 12 |
| 4,018,123 | 4/1977 | Sugiura | 84/1.03 |
| 4,058,043 | 11/1977 | Shibahara | 84/1.03 |
| 4,160,399 | 7/1979 | Deutsch | 84/1.03 |
| 4,183,277 | 1/1980 | Kniepkamp et al. | 84/1.03 |
| 4,186,635 | 2/1980 | Aoki et al. | 84/1.01 |

*Primary Examiner*—J. V. Truhe
*Assistant Examiner*—Forester W. Isen

[57] ABSTRACT

Music playing apparatus for playing selected musical notes in accordance with a selected rhythm pattern. A rhythm pattern is selected having a multiplicity of intervals. The rhythm pattern is repetitively reproducible and musical notes played at any interval within the rhythm pattern may be selectively played as either an unaccented note or as an accented note. Selected musical notes are played at each interval within the rhythm pattern and the pitch of a selected note is determined. The pitch of a selected note is within a predetermined range of octaves in the chromatic scale and this range of octaves may be selectively extended. A tone generator generates audible musical tones in accordance with the established rhythm pattern, the selected musical notes, and the octave band within which the selected musical notes are found.

14 Claims, 9 Drawing Figures

| | | | | | | | | | |
|---|---|---|---|---|---|---|---|---|---|
| L3 | $C_6$ | $C_6^{\#}$ | $D_6$ | | $B_6$ | $C_7$ | $C_7^{\#}$ | | $B_7$ |
| $L_2$ | $C_4$ | $C_4^{\#}$ | $D_4$ | | $B_4$ | $C_5$ | $C_5^{\#}$ | | $B_5$ |
| $L_1$ | $C_2$ | $C_2^{\#}$ | $D_2$ | | $B_2$ | $C_3$ | $C_3^{\#}$ | | $B_3$ |
| L0 | $C_0$ | $C_0^{\#}$ | $D_0$ | | $B_0$ | $C_1$ | $C_1^{\#}$ | | $B_1$ |
| | $C_0$ | $C_0^{\#}$ | $D_0$ | ... | $B_0$ | $C_1$ | $C_1^{\#}$ | ... | $B_1$ |

| | | | |
|---|---|---|---|
| LS2 | $C_4$–$B_5$ | $C_4$–$B_7$ | $C_4$–$B_7$ |
| LSI | $C_2$–$B_3$ | $C_2$–$B_5$ | $C_2$–$B_7$ |
| LSO | $C_0$–$B_1$ | $C_0$–$B_3$ | $C_0$–$B_5$ |
| | ESO | ESI | ES2 |

MUSIC PLAYING APPARATUS

BACKGROUND OF THE INVENTION

This invention relates to an automatic music playing system with a multiplicity of selectably synchronized music playing channels, each channel playing continuous music according to a tempo, rhythm pattern, and tone controls immediately variable by the player.

The playing of conventional musical instruments (e.g., piano, flute, violin) requires the development of specialized skills in order to produce music. Not everyone is able, for various reasons, to acquire or develop these skills to the point where the playing of a musical instrument is an enjoyable experience rewarding to both the player of the instrument or someone hearing it played. Still, music is considered a cornerstone of culture and history teaches us that music has always been an important part of society.

Recently, automatic musical instruments and music playing systems have been developed. U.S. Pat. No. 4,058,043 to Shibahara and 4,142,433 to Gross are but two examples of this type of instrument or system. Such instruments have an advantage in that one having the skills to play traditional musical instruments can produce music with them. However, present automatic musical instruments or systems do have drawbacks. Some, for example, are limited in versatility being able to play only chords while others have only one degree of not accentuation. As a consequence, the person using the instrument cannot give full play to his musical knowledge or talents.

SUMMARY OF THE INVENTION

It is an object of this invention to provide a music playing apparatus that enables persons at any level of musical knowledge and with no particularly relevant physical skill to compose and play music which would either require considerable skill to play on conventional musical instruments, or would require considerable musical knowledge to program on other automatic music playing systems or automatic musical instruments lacking the particular control features of this invention.

It is also an object of this invention to provide an economical source of musical creativity to beginning musicians as well as to the musically erudite.

It is another object of this invention to provide a simple way to automatically execute an enormous multiplicity of substantially different and distinct music patterns. The player of this invention, modifying the patterns under execution and controlling the various qualities of the continuous play, generates music characterized by structure and expression; the sophistication and complexity of the musical patterns depends on the musical resourcefulness of the player. Thus a person may play virtually unlimited musical sequences including chords, arpeggios, scales, trills, glissandi, and complex passages in general.

It is a further object of this invention to aid the beginning student of music to quickly develop understanding of music theory and structure.

It is yet another object of this invention to enable handicapped persons, lacking the facility to play conventional manual musical musical instruments, to compose and play music with playing speeds exceeding those possible with nonautomatic musical instruments; and for deaf persons to play, perceive, and enjoy music.

The above and other objects, features, and advantages of this invention will become apparent from the following detailed description when taken in conjunction with the accompanying drawings.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
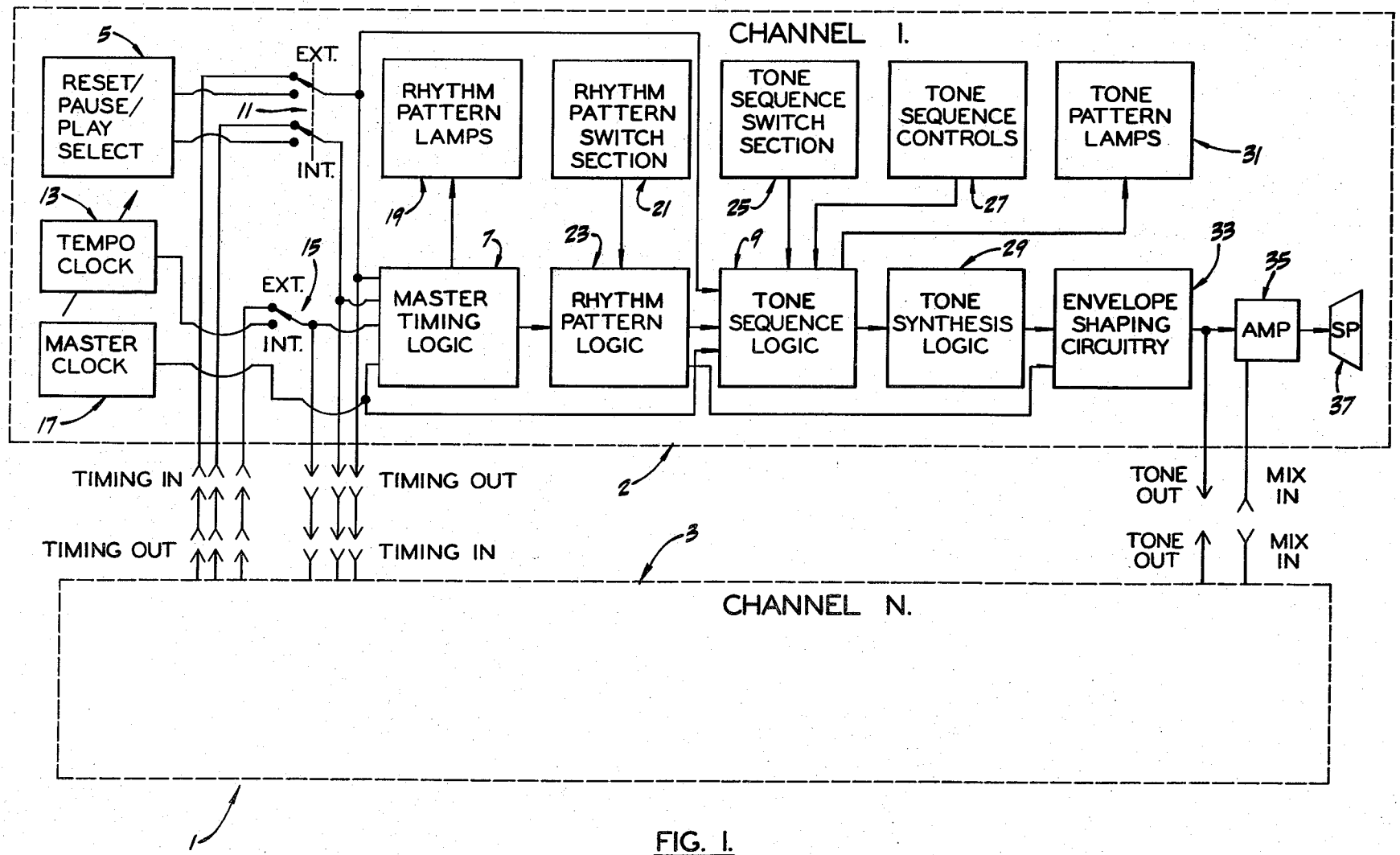
FIG. 1 is a block diagram of an embodiment of the music playing apparatus according to this invention.

Referring to the accompanying drawings, FIG. 1 illustrates a music playing apparatus 1 according to this invention, in which a multiplicity of channels are interconnected such that the primary timing outputs of a first channel 2 are used as the external timing inputs to other channels; it being understood that the apparatus may comprise N such channels.

Block diagram description is made hereinbelow on the operation of a single channel. A reset/pause/play select means 5 is connected to a master timing logic 7 and a tone sequence logic 9 through a switch 11 so a player may select between internal or external reset/-pause/play control. A tempo clock 13 is connected to master timing logic 7 through a tempo source switch 15 so a player may select between internal or external tempo signals. Tempo clock 13 generates a variable frequency timing signal for establishing the tempo with which a selected rhythm pattern is produced. A master clock 17 is connected to master timing logic 7 and to tone sequence logic 9. The master clock generates an electrical signal which synchronizes master timing logic 7 with tone sequence logic 9. Rhythm pattern lamps 19 are connected to master timing logic 7 for display of the status of the master timing logic. Output of master timing logic 7 and a rhythm pattern switch section 21 are connected to a rhythm pattern logic 23. Rhythm pattern logic 23 produces a rhythm pattern according to control signals from master timing logic 7 and according to information contained in rhythm pattern switch section 21.

Rhythm pattern logic 23, a tone sequence switch section 25, and a tone sequence control 27 are connected to tone sequence logic 9 to determine the rhythm and tone sequence played. One output of tone sequence logic 9 is connected to a tone synthesis logic 29. This output specifies the tone to be generated. Another output of tone sequence logic 9 is connected to tone pattern lamps 31 to display the note sequence being played. The output of tone synthesis logic 29 and an output from rhythm pattern logic 23 are provided as inputs to an envelope shaping circuitry 33. A signal from rhythm pattern logic 23 determines the commencement and amplitude of the envelope that modulates the tone output from tone synthesis logic 29. The output of envelope shaping circuitry 33 is connected to an amplifier 35, the output of which is connected to a speaker 37 to produce audible music.

Figure 3:
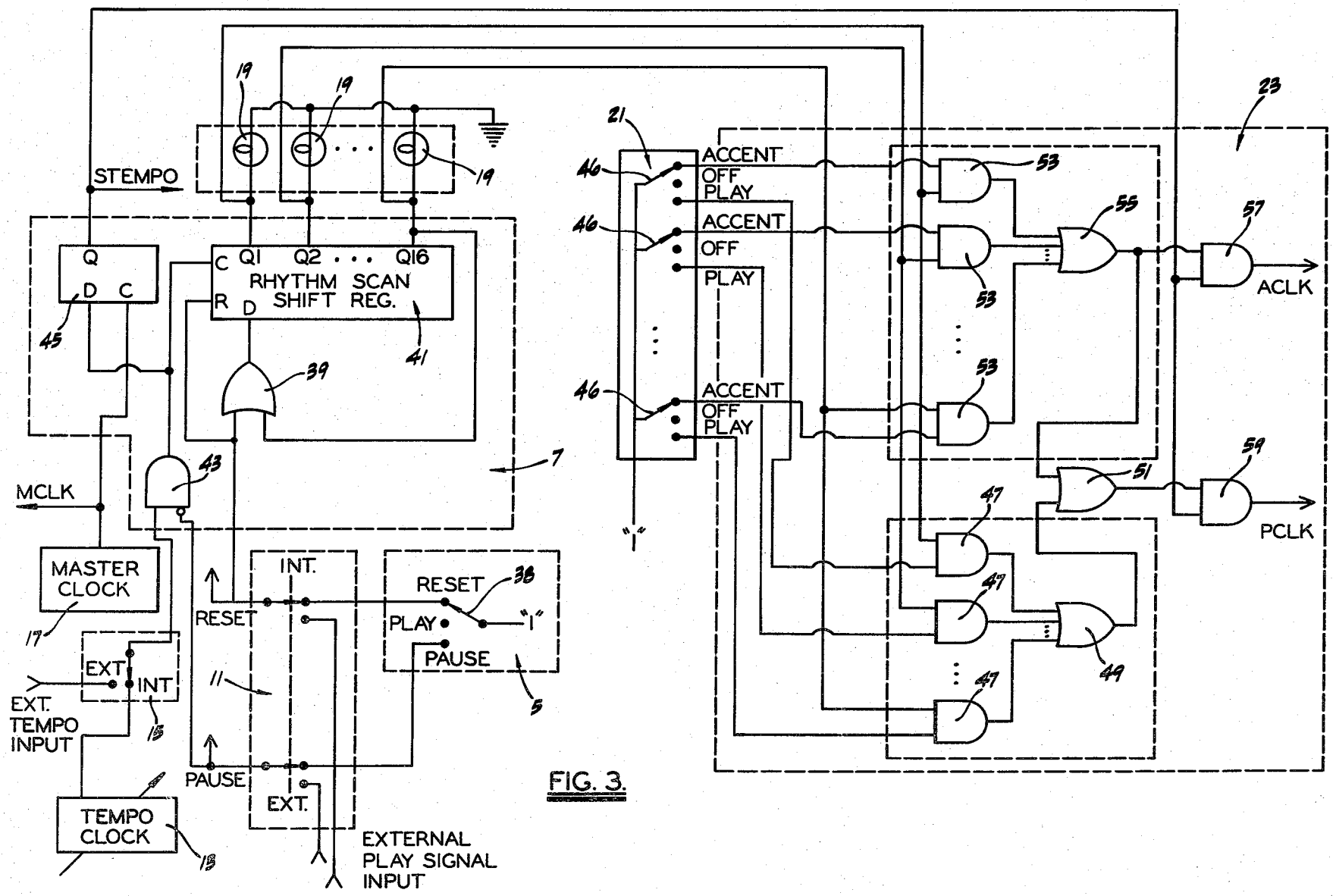
FIG. 3 is a schematic circuit diagram for a rhythm logic portion of the apparatus.

Referring to FIG. 3, reset/pause/play means 5 comprises a reset/pause/play switch 38 connected to master timing logic 7 through play signal source switch 11. A voltage representing a logic high or "1" is supplied as an input to switch 38. When switch 11 is set to internal or INT, this logic "1" is connected to master timing logic 7. When switch 38 is set to RESET and switch 11 is set to INT, the logic "1" is connected to one input of an OR gate 39 and to the reset input R of a rhythm scan shift register 41. Shift register 41 has plurality of stages, the number of stages being determined by the number of intervals within the rhythm pattern. The logic output of gate 39 is connected to the serial data input D of shift register 41. For this condition, a logic "1" is loaded into the first stage of shift register 41 while the other stages of the shift register are cleared. After rhythm scan shift register 41 is reset, reset/pause/play switch 38 is set to its PLAY position. With switch 38 set to PLAY, the RESET and PAUSE outputs of switch 11 are a logic low or "0".

Tempo source switch 15 is now set to its internal or INT position. This allows pulses from tempo clock 13 to pass through switch 15 and be provided to one input of AND gate 43. This gate has a second input which is supplied from switch 11. With switch 38 set to PLAY, this second input is a logic "0" which is inverted at the gate 43 input to a logic "1". This permits gate 43 to pass clock pulses from tempo clock 13 to the clock input C of shift register 41 and to the data input D of a tempo synchronization flip-flop (FF) 45. These tempo clock pulses sequentially advance the "1" bit in the first stage of shift register 41 through the stages of the shift register until the "1" bit reaches the last stage of the shift register. The output of the last stage of the shift register 41 is routed back to the serial data input D of the shift register through OR gate 39. Thus, the "1" bit is reloaded into the first stage of the shift register 41 after being shifted through the shift register. The "1" bit is therefore circulated continuously through shift register 41 according to the rate of tempo clock 13. Shift register 41 is thus a circular shift register for repetitively reproducing a selected rhythm pattern.

Master clock 17 generates a timing signal MCLK which is supplied to the clock input C of tempo synchronization FF 45. The output of FF 45 is a tempo pulse STEMPO which is synchronized with the leading edge of a pulse train from master clock 17 comprising timing signal MCLK. The output of each stage of shift register 41 is connected to a separate rhythm pattern lamp 19. Sequential illumination of each of these lamps indicates the sequential transmission of the "1" bit through each stage of rhythm scan shift register 41 so a player knows which interval of the rhythm pattern he is at at any time.

Rhythm pattern switch section 21 comprises a set of three-position switches 46. The number of switches 46 in section corresponds to the number of stages in shift register 41, for example, sixteen. It will be understood that the number of shift register stages and hence the number of switches 46 may be greater or less than sixteen. Each switch 46 has an OFF position and two on positions. One on position, the PLAY position, designates that a note at that interval in the rhythm pattern is to be played without accent. The other on position, the ACCENT position, designates that a note at that interval in the rhythm pattern is to be played with accent. The OFF position designates that no note is to be played during that interval.

Rhythm pattern logic 23 includes a first set of logic gates, one for each interval within the rhythm pattern. These gates are the AND gates designated 47 in FIG. 3. The PLAY position of each switch 46 in section 21 is connected to one input of its corresponding gate 47. The other input of each gate 47 is connected to the Q output of its corresponding shift register 41 stage. If the "1" bit being shifted through the shift register 41 is at the stage in the shift register corresponding to a switch 46 for which the switch is set to PLAY, the appropriate gate 47 has a logic "1" output. The outputs of each AND gate 47 are connected to inputs of an OR gate 49. The output of gate 49 is, in turn, connected to the one input of an OR gate 51. A logic "1" output from any gate 47 thus propagates through gate 49 to the input of gate 51.

Rhythm pattern logic 23 also includes a second set of logic gates, also one for each interval within the rhythm pattern. These gates are the AND gates 53 in FIG. 3. The ACCENT position of each switch 46 is connected to one input of the corresponding gate 53. The other input of each gate 53 is connected to the Q output of the corresponding stage of shift register 41. If the "1" bit being shifted through shift register 41 is at the stage in the shift register corresponding to a switch 46 for which the switch is set to ACCENT, the appropriate gate 53 has a "1" output. The outputs of each AND gate 53 are connected to inputs of an OR gate 55. The output of gate 55 is connected to both a second input of gate 51 and to one input of AND gate 57. A logic "1" output from any gate 53 propagates to an input of both gates 51 and 57.

The output of gate 51 is logic "1" whenever the input to the gate from either gate 49 or gate 55 is "1". The output of gate 51 is connected to one input of an AND gate 59. The STEMPO signal from FF 45 is supplied as a second input to both gate 57 and gate 59. Thus when an element of the STEMPO signal is coincident with a "1" input to gate 59, a PCLK signal is propagated by the gate. A PCLK signal indicates that a note (whether accented or unaccented) is to be played for the particular rhythm pattern interval. If an element of the STEMPO signal is coincident with a "1" input to gate 57, an ACLK signal is propagated by the gate. This indicates that the note played for the particular rhythm pattern interval is played as an accented note. Both the PCLK and ACLK signals are synchronized with the MCLK signal generated by master clock 17. It is understood that the present embodiment may be extended to include more than one degree of accentuation.

Figure 4A:
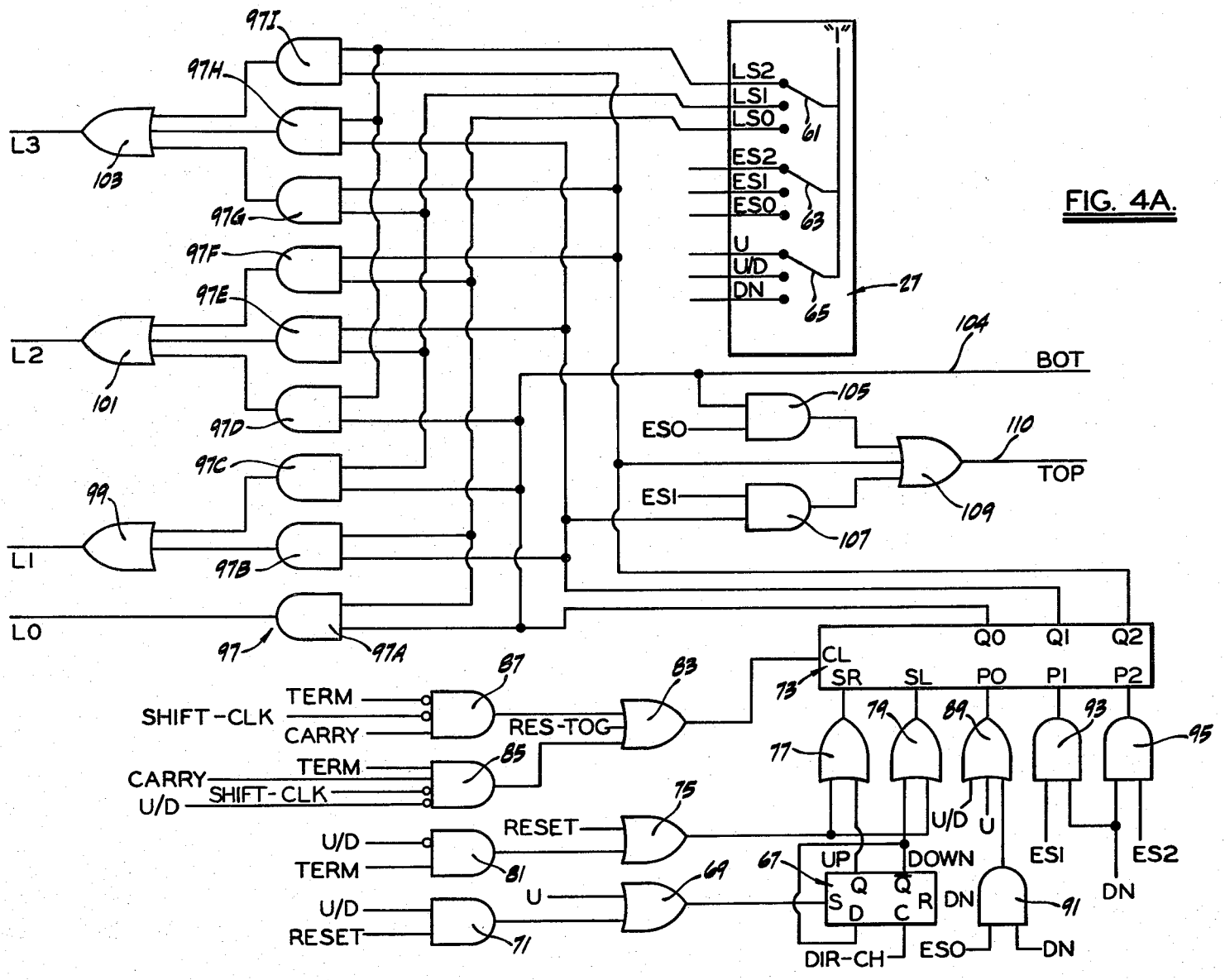
FIGS. 4A and 4B are schematic circuit diagrams for a tone sequence logic portion of the apparatus.
Figure 4B:
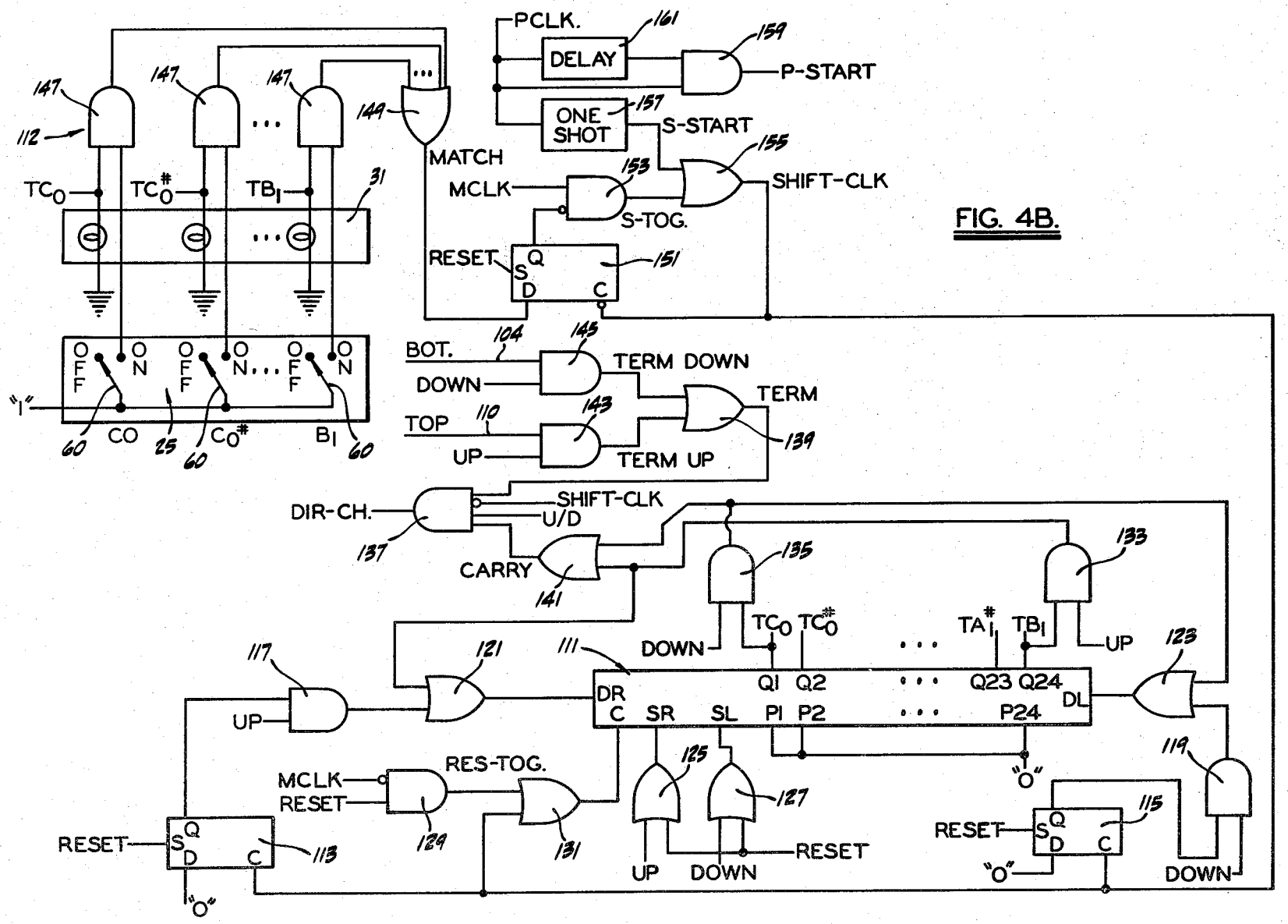

Referring to FIG. 4B, tone sequence switch section 25 comprises a plurality of tone select switches 60. Each switch 60 corresponds to a different tone in the chromatic scale. While the present description is based on as many switches 60 as are required to span two octaves of the chromatic scale (see FIG. 2), it is understood that the number of octaves may be greater or less than two octaves. A logic "1" is supplied to each switch 60. The player selects the notes to be included in the sequence to be played by setting the switches corresponding to those notes to the ON position. Notes are deselected by the player by setting switches to their OFF position. Switch 60 settings may be modified at any time before or while the apparatus is playing and the play immediately reflects the change in settings. For each switch 60 set in the ON position, the logic "1" propagates to the output of the switch to indicate that a tone should be played for that switch position.

Referring to FIG. 4A, the band of octaves in the chromatic scale in which tones to be played are selected may be one of a plurality of bands. Tone sequence control 27 includes a first tone control means comprising a tone range level switch 61 and associated circuitry for determining the pitch of a selected note to be played. The primary band of octaves is selected by switch 61 by changing the switch setting any time before or during play and the band of octaves in which the notes are playing changes immediately. A logic "1" is supplied to switch 61. When switch 61 is positioned at LS0, the LS0 signal is at logic "1" indicating that the lowest band of octaves is used as the primary band of octaves. When switch 61 is positioned at LS1, the LS1 signal is at logic "1" indicating that the first band of octaves above the lowest is used as the primary band of octaves. When switch 61 is positioned at LS2, the LS2 signal is at logic "1" indicating that the second band of octaves above the lowest is used as the primary band of octaves.

Figures 2, 6, 7:
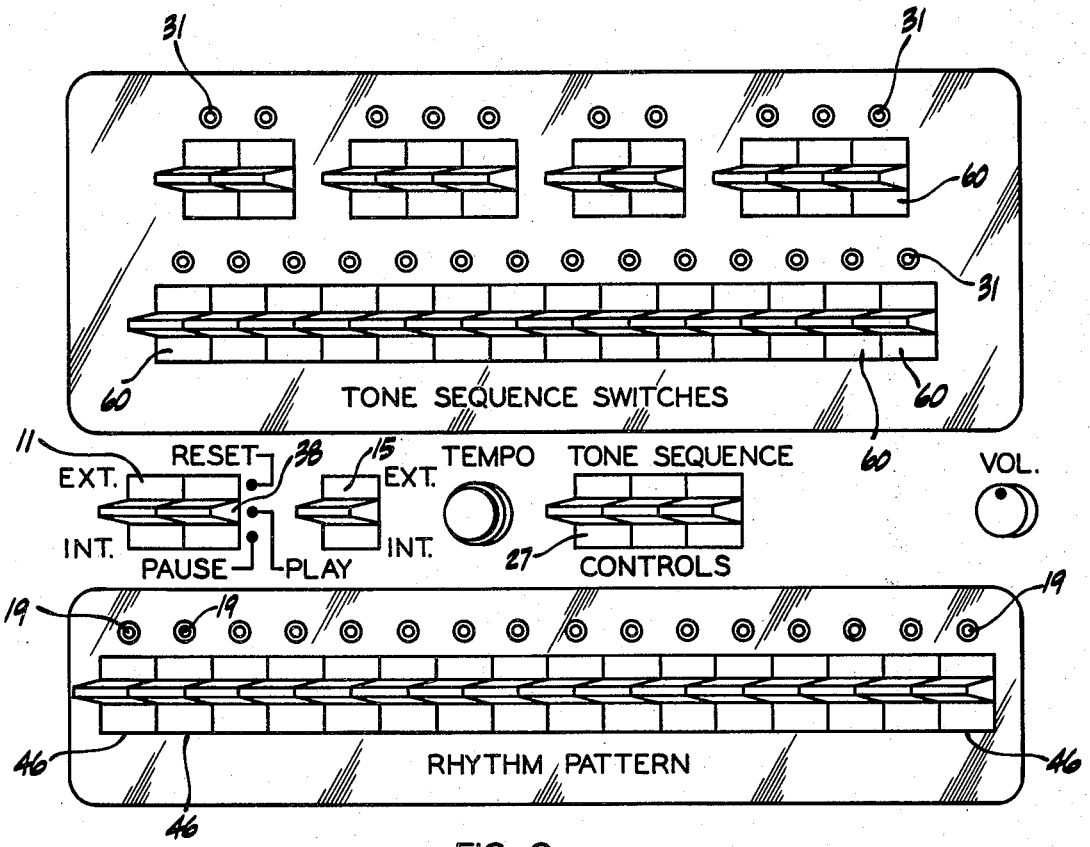
FIG. 2 illustrates controls and indicators for each channel of the music playing apparatus.
FIG. 6 is a logic table illustrating the notes selected according to output signals of the tone sequence logic.
FIG. 7 is a logic table illustrating the note ranges resulting from various combinations of player controls.

A second tone control is included in tone sequence control 27. This second tone control is for selectively extending the number of bands of octaves in the chromatic scale within which a note is played. Thus during play, when the sequence of notes in one band of the chromatic scale is completed, play extends to the next adjacent band where it is repeated but at a different pitch band. As a result, the band of octaves in which selected notes are played is extended beyond the band of octaves selected by the first tone control. The second tone control includes a tone range extension switch 63 and associated circuitry. A logic "1" is supplied to switch 63. When switch 63 is positioned at ES0, the ES0 signal is at logic "1" indicating that no extension of the tone range is used. This condition confines the note sequence to a single band of octaves as the pitch range. When switch 63 is positioned at ES1, the ES1 signal is at logic "1" indicating that the note sequence may extend to the next band of octaves when the note sequence is completed in its primary band of octaves. When switch 63 is positioned at ES2, the ES2 signal is at logic "1" indicating that the note sequence extends to the next two bands when the note sequence is completed in its primary band of octaves. The various band ranges that can be selected are shown in FIG. 7. Note that the band range is a function of the tone range level switch 61 settings (LS0, LS1, and LS2) and the tone range extension switch 63 settings (ES0,ES1, and ES2).

Sequences of notes may be played in ascending or descending order or alternatively ascending and descending. This feature is controlled by a tone sequence direction switch 65. A logic "1" is supplied to switch 65. When switch 65 is positioned at U, the U signal is at logic "1" indicating that the tone sequence is to be ascending only. In this condition, the tone sequence restarts at the lowest note in its primary band of octaves after it plays the highest note in its highest permitted band, and the ascending sequence repeats. When switch 65 is positioned at DN, the DN signal is at logic "1" indicating that the tone sequence is to be descending only. In this condition, the tone sequence restarts at the highest note in its highest permitted band after it plays the lowest note in its primary band, and the descending sequence repeats. When switch 65 is positioned at U/D, the U/D signal is at logic "1" indicating that the tone sequence is to alternate between ascending and descending. Switch 65 is also included in tone sequence control 27.

The tone sequence scanning direction is specified by the outputs of a direction FF 67. The U position of switch 65 is connected to one input of an OR gate 69, the output of which is connected to the set input S of FF 67. The U/D position of the switch is connected to one input of an AND gate 71, the output of which is connected to the other input of gate 69. The other input to gate 71 is the RESET position of switch 38. Direction FF 67 is set to UP through the output of gate 69 if either the U input is at logic "1" from switch 65 or if the output of gate 71 is at logic "1". The DN position of switch 65 is connected to the reset input R of FF 67 so to set FF 67 to DOWN when switch 65 is set to DN. A direction change pulse DIR-CH, whose origin is described hereinafter, is connected to the clock input C of direction FF 67. Since the $\overline{Q}$ output of FF 67 is connected to the data input D of the flip-flop, the DIR-CH pulse reverses the output levels of the flip-flop thus reversing the scanning direction. So, although switch 65 determines the scanning mode (i.e., uponly, down only, or alternately up and down), the scanning direction at any point in time is specified by the UP and DOWN outputs of direction FF 67. Note that UP relates to the right scanning of switch section 25 while DOWN relates to the left scanning of the switch section.

As indication of current tone range offset relative to the primary band of octaves is maintained in a tone range shift register 73. Register 73 has three parallel inputs (P0, P1, P2) and three parallel outputs (Q0, Q1, Q2). The RESET setting of switch 38 is connected to one input of OR gate 75, the output of which is connected to one input of both an OR gate 77 and an OR gate 79. The $\overline{Q}$ output of FF 67 is connected to the other input of gate 77, while the Q output of the flip-flop is connected to the other input of gate 79. The output of gate 77 is connected to a shift right (SR) input of register 73 and the output of gate 79 is connected to a shift left (SL) input of the register. The U/D position of switch 65 is connected to an inverting input of an AND gate 81 which has a second input a TERM signal whose origin is described hereinafter. The output of gate 81 is connected to a second input of gate 75.

A three-input OR gate 83 has its output connected to the clock input CL of shift register 73. The inputs to gate 83 are a reset-toggle signal (RES-TOG) whose origin is described hereinafter and the respective outputs of a pair of AND gates 85 and 87. Gate 85 has two inverting inputs designated U/D and SHIFT-CLK respectively and two non-inverting inputs designated CARRY and TERM respectively. Origin of the SHIFT-CLK and CARRY inputs is described hereinafter. The TERM and SHIFT-CLK inputs to gate 85 are also provided to inverting inputs a gate 87, while the CARRY input is provided as a third and non-inverting input to this gate.

The output of an OR gate 89 is connected to the P0 input of shift register 73. Gate 89 has three inputs, two of which are the U/D and U positions of switch 65. The third input to gate 89 is the output of an AND gate 91. An AND gate 93 has its output connected to the P1 input of the shift register, and an AND gate 95 has its output connected to the P2 input of the register. Each gate has, as a common input, the DN setting of switch 65. Gate 93 has, as a second input, the ES1 position of switch 63, while gate 95 has, as a second input, the ES2 position of this switch.

The parallel inputs (P0,P1,P2) of shift register 73 are loaded upon the positive edge of a clock input while both SR and SL inputs are at logic "1" simultaneously. This occurs when switch 38 is set to its RESET position and a logic "1" is supplied to gate 75 making its output to gates 77 and 79 a logic "1". The other case in which SR and SL are set to logic "1" simultaneously is when switch 65 is set to other than its U/D position and the TERM signal is at logic "1". This makes the output of gate 81 a logic "1" causing the output of gate 75 to also be at logic "1". This in turn causes the outputs of gates 77 and 79 to be logic "1" and sets the SR and SL inputs of register 73 to logic "1".

Shift register 73 has a load mode, specified by SR and SL at logic "1" simultaneously, and a shift mode, specified by a logic "1" at one but not both SR and SL inputs. In the load mode, the clock input of register 73 causes parallel loading; whereas in the shift mode, the clock input causes shifting of the bit pattern. The clock input to register 73 required for parallel loading comes from the RES-TOG pulse train. This pulse train propagates through gate 83 to the clock input of the shift register. The inputs to gates 85 and 87 determine shift mode clocking of the shift register.

The parallel inputs to shift register 73 are used to set the initial tone band offset. The P0 input, representing the lowest tone band offset, is set to logic "1" when the output of gate 89 is set to logic "1". This occurs when switch 65 is set to either its U or U/D position thus causing the output of gate 89 to be a logic "1". If swith 65 is set to its DN position and switch 63 to its ES0 position, then gate 91 will have a logic "1" output. This also makes the output of gate 89 a logic "1". The P1 input of shift register 73 is set to logic "1" when switch 65 is set to its DN position and switch 63 to its ES1 position. This makes both inputs to gate 93 a logic "1" and the output of the gate to the P1 input a logic "1". The P2 input of register 73 is set to logic "1" when switch 65 is set to its DN position and switch 63 to its ES2 position. This results in gate 95 having a logic "1" output.

The parallel outputs (Q0,Q1,Q2) of register 73 represent tone band offset. This offset specifies the level of the band of octaves (with respect to the lowest or primary band as specified by the tone range level switch 61) in which a tone is to be played. When switch 63 is set to ES0, no band extension is specified and the Q0 output of the register is at logic "1" throughout play. When band extensions are specified by switch 63 being set to either ES1 or ES2, the logic "1" bit at either the Q1 or Q2 position in register 73 shifts one position right or left. This shifting occurs when the scanning of the tone select switches 60 is complete and the tone band must be advanced one level up or down, respectively. When the U/D mode is selected and scanning is completed for the last tone in the last band (i.e., the end of the range) according to FIG. 7, the bit pattern in register 73 is not advanced. Rather, the direction specification at the SR and SL inputs of the shift register is reversed.

The tone band offsets (Q0, Q1, Q2 of shift register 73) are "anded" with the tone range level (LS0, LS1, LS2 of switch 61).

As shown in FIG. 4A, the second tone control includes a set 97 of AND gates designated 97A through 97I. The outputs of gates 97B and 97C are connected as inputs to an OR gate 99; the outputs of gates 97D, 97E, and 97F to the inputs of an OR gate 101; and, the outputs of gates 97G, 97H, and 97I are connected to the input of an OR gate 103. The Q0 output of tone range shift register 73 is provided as an input to gates 97A, 97C, and 97D. The Q1 output of the shift register is provided as an input to gates 97B, 97E, and 97H. The Q2 output of the shift register is provided to gates 97F, 97G, and 97I. The LS0 position of switch 61 is connected as an input to gates 97A, 97B, and 97F. The LS1 position of the switch is connected as an input to gates 97C, 97E, and 97G. The LS2 position of the switch is connected as an input to gates 97D, 97H, and 97I.

In addition to the above, the Q0 output of shift register 73 is supplied on a line 104, designated BOT, and is provided as one input to an AND gate 105. This gate has, as a second input, the ES0 setting of switch 63. Further, the Q1 output of the shift register is one input to an AND gate 107. The outer input to this gate is the ES1 setting of switch 63. Also, the Q2 output of the register is one input to an OR gate 109. Gate 109 has as other inputs, the outputs of gates 105 and 107. The output of gate 109 is supplied on a line 110 and is designated TOP. The outputs of gates 97, connected to the inputs of gates 99,101, and 103, produce tone band selection signals L0, L1, L2, and L3. If the signal on line 110 from gate 109 is logic "1", then the "1" bit in shift register 73 is at its top allowable position as determined by switch 63. This condition can occur under three mutually exclusive conditions, corresponding to the three inputs to gate 109. The first condition is the Q2 output of shift register 73 at logic "1". The second condition is the Q1 output of register 73 at "1" while ES1 is at logic "1". This causes the output of gate 107 to be at logic "1". And, the third condition is when the Q0 output of 73 is a logic "1" while ES0 is at logic "1". This causes the output of gate 105 to be logic "1". The use of the TOP and BOT signals is described later.

Advancing of the "1" bit in shift register 73 occurs when the positive edge of a pulse arrives at the clock input of the register from the output of gate 83. During play, the RES-TOG input to gate 83 is at logic "0". A pulse is supplied by gate 87 when a carry occurs during a non-terminal situation (i.e., when TERM is logic "0") and when the SHIFT-CLK pulse has a negative edge. The occurrence of a carry during a non-terminal situation is described hereinafter. The result is the "1" bit in shift register 73 being advanced either left or right. When a carry occurs in a terminal situation (i.e., when TERM is logic "1") and the U/D mode is not selected, the negative edge of the SHIFT-CLK pulse causes a pulse to be supplied by gate 85 to gate 83. Further, the output of gate 81 is also at logic "1" and this logic "1" propagates through gates 75, 77, and 79 to set both the SL and SR inputs of shift register 73 to logic "1" establishing the load mode in the shift register. Now, a clock pulse from gate 85 causes a parallel load of the shift register. This places a "1" bit in the register at a starting position. In summary, the positive edge of a clock pulse from gate 87 advances the bit position in register 73 during its shift mode while the positive edge from gate 85 is used in the load mode to reinitialize the bit position by reloading during either up-only operation or down-only operation.

Referring to FIG. 4B, the tone select means further includes a tone scan shift register 111 for scanning the tone select switches 60 to determine which notes have been selected for play. Register 111 has a number of stages equal to the number of switches 60, for example, twenty-four. Register 111 has both serial and parallel input and a parallel output. In operation, a "1" bit is loaded into the register and shifted in one direction or the other depending upon setting of direction switch 65. In addition, the tone select means includes a set 112 of logic gates corresponding in number to the number of tone select switches, i.e. twenty-four. Each gate has as a first input a voltage applied through its corresponding tone select switch when the switch is closed. Each gate has as a second input, a logic level from the corresponding stage of shift register 111. The voltage represented by the logic level when the "1" bit is shifted through the corresponding stage of register 111 together with the voltage applied through the corresponding switch 60 causes the gate to propagate a signal indicating that that particular note within a predetermined band of octaves is to be played.

When switch 38 is set to RESET, a logic "1" is supplied to the set input S of a pair of flip-flops, 113 and 115 respectively. The Q output of FF 113 is connected to one input of an AND gate 117 while the Q output of FF 115 is connected to one input of an AND gate 119. The output of gate 117 is tied to one input of an OR gate 121, and the output of gate 119 is connected to one input of an OR gate 123. The output of gate 121 is connected to a serial data right-shift input DR of register 111 while the gate 123 output is connected to a serial data left-shift input DL of the register. Gate 117 has as a second input the UP output of FF 67; the DOWN output of the flip-flop is connected to a second input of gate 119.

The RESET position of switch 38 is also connected to one input of an OR gate 125 and an OR gate 127. The UP output of FF 67 is connected to a second input of gate 125, and the output of the gate is connected to a shift right input SR of the register.

Lastly, the reset position of switch 38 is connected to one input of an AND gate 129. Gate 129 has as a second and inverted input the master clock signal MCLK from master clock 117. The output of gate 129 is a pulsed signal designated RES-TOG. This signal is applied to one input of OR gate 83 as previously described and to one input of an OR gate 131. The output of OR gate 131 is connected to the clock input C of register 111.

Shift register 111 has a load mode specified by inputs SR and SL at logic "1" simultaneously and a shift mode specifiec by a logic "1" at one but not both SR and SL inputs. In the load mode, the clock input C of register 111 causes parallel loading; whereas in the shift mode, the clock input causes shifting. Initialization of the shift register 111 occurs when switch 38 is set to its RESET position. This sets FF 113 and FF 115 so their Q outputs are a logic "1". If the UP output of FF 67 is at logic "1", gate 117 will have a logic "1" output which, in turn, makes the output of gate 121 a logic "1". The result is a logic "1" at the DR input of the register. If the DOWN output of FF 67 is at logic "1", a logic "1" is loaded into the DL input of the register. Further, the RESET position of switch 38 propagates a logic "1" through gates 125 and 127 setting both SR and SL inputs of the register at logic "1" simultaneously. The logic "1" level of the RESET signal at the input of gate 129 qualifies the gate to pass pulses of the MCLK signal and create the RES-TOG signal. The pulse train RES-TOG continues so long as RESET is at logic "1". The RES-TOG pulse train then propagates through gate 131 to the clock input of register 111 thereby loading the register with all 0's.

When switch 38 is set to PLAY, the RESET input to gates 125 and 127 is logic "0". Now, the UP and DOWN outputs of direction FF 67 determine which gate has a logic "1" output to the SR or SL inputs of register 111. Because FF 113 and FF115 were set during initialization, the logic "1" level will remain at either the DR or DL inputs of the register, again depending upon the outputs of direction FF 67. A SHIFT-CLK signal (the origin of which is described hereinafter) is supplied to a second input of gate 131 and to the clock inputs C of FF 113 and FF 115. The positive edge of a SHIFT-CLK signal when sensed at the clock input of register 111 in the shift mode triggers a shift of the "1" bit present at the DR or DL input of the register. The direction of shift is determined by whether the register has a logic "1" at its SR or SL input. The Q outputs of FF 113 and FF 115 go to logic "0" when a negative edge of a SHIFT-CLK signal is sensed at the clock input of each flip-flop.

Shift register 111 is configured for circular operation. When right shifting is specified and the "1" bit in the register is at Q24, the bit is supplied to one input of an AND gate 133. The UP output of direction FF 67 is a second input to this gate and enables the gate to direct the "1" bit to a second input of gate 121 and back to the DR input of the register. When left shifting is specified and the "1" bit is at Q1, this end around carry is accomplished via an AND gate 135 and gate 123.

A direction change pulse DIR-CH is created when switch 65 is set to its U/D position. The U/D position of switch 65 is connected to one input of an AND gate 137. Gate 137 also receives the TERM signal as an input from an OR gate 139 and a CARRY signal from an OR gate 141. Both gates 133 and 135 have their outputs connected as inputs to an OR gate 141, and the resultant CARRY signal is also supplied to gates 85 and 87 as previously noted. The SHIFT-CLK signal is also provided to gate 139 via an inverting input of the gate. A DIR-CH signal is produced when switch 65 is set to U/D, the TERM and CARRY signals are at logic "1", and the negative edge of a SHIFT-CLK signal occurs.

A terminal situation arises when tone band offset outputs (Q0, Q1, Q2) of shift register 73 are at an extreme as determined by the setting of the tone range extension switch 63. OR gate 139 receives as inputs the output of an AND gate 143 and an AND gate 145. Gate 143 has one input connected to the UP output of FF 67, and as a second input, the TOP signal on line 110. OR gate 145 has one input connected to the DOWN output of FF 67, and as a second input, the BOT signal on line 104. A TERM-UP logic "1" is produced by gate 143 when the TOP signal is at logic "1" and when the UP output of FF 67 is logic "1". A TERM-DOWN logic "1" is produced by gate 145 when the BOT signal is at logic "1" and the DOWN output of FF 67 is logic "1". Gate 139 produces a terminal situation (i.e., TERM at logic "1") when either of its inputs, TERM-UP or TERM-DOWN, is at logic "1". As noted above, the DIR-CH signal is used as an input to direction FF 67 to reverse the direction indicated by the outputs of the flip-flop.

The outputs of tone scan shift register 111 are used to drive tone pattern lamps 31, there being one lamp associated with each switch 60, and to scan the tone select switches 60, switch by switch, to locate the next sequential switch set to ON or at logic "1". The corresponding shift register position specifies the pitch of the next tone to be played. Each output of register 111 is connected to a lamp 31 so the current position of the "1" bit in the shift register is indicated by illumination of the lamp. Each output of register 111 is also connected to an AND gate 147 in the set 112 of logic gates. The other input of each gate, as noted, is connected to a corresponding switch 60. Whenever the position of the "1" bit in register 111 corresponds to a switch 60 that is ON, the output of the associated gate 147 is at logic "1". The outputs of all the gates 147 are connected as inputs to an OR gate 149. The output of gate 149 is a signal designated MATCH and indicates there is a match of the location of the "1" bit in register 111 and the location of a switch 60 which is ON.

The MATCH signal from gate 149 is connected to the data input D of FF 151. The set input S of FF 151 is connected to the RESET position of switch 38. The Q output of FF 151 is connected to the inverting input of an AND gate 153. The other input to gate 153 is the MCLK signal from master clock 17, and the output of gate 153 is connected to one input of an OR gate 155. A one-shot 157, triggered by the PCLK signal, generates an S-START signal which is applied to a second input of gate 155. The signal produced by gate 155 is designated SHIFT-CLK and is supplied to the clock input C of FF 151 and to FF 113, FF 115, gate 131, gate 137, gate 85, and gate 87. The PCLK signal is supplied to both inputs of an AND gate 159, although one of the input lines is routed through a delay circuit 161. When switch 38 is set to RESET, the Q output of FF 151 is set to logic "1", which output is connected to the complementary input of gate 153. This inhibits gate 153 from passing elements of the MCLK signal. The output of gate 153 is a shift toggle pulse train designated S-TOG.

Shifting the "1" bit in register 111 from one stage to the next is triggered by appearance of the positive edge of a PCLK signal at the input of one-shot 157. One-shot 157 produces a brief pulse approximately as long as MCLK. This pulse starts the shifting and is designated S-START. The S-START signal passes through gate 155 and becomes an initial pulse in the SHIFT-CLK signal. The positive edge of a SHIFT-CLK pulse passes through gate 131 to advance the bit pattern in shift register 111.

The new bit position in register 111 may or may not result in a match condition with a switch 60. In either case, the match state is transferred from the data input D of FF 151 to the Q output as soon as the negative edge of the SHIFT-CLK signal arrives at the clock input (inverted) of FF 151. If the last shift of shift register 111 resulted in a no-match (i.e., MATCH signal at logic "0"), the clocking of FF 151 puts a logic "0" at its Q output. This logic "0" at the Q output of FF 151 enables MCLK to pass through gate 153 and gate 155 to create another SHIFT-CLK pulse. The SHIFT-CLK pulses originating from gate 155 continue so long as no match exists.

When a shift of the "1" bit in register 111 results in a MATCH signal at logic "1", this logic "1" is applied to the data input D of FF 151. Now, the clocking of FF 151 prevents any more MCLK pulses from passing through gate 153 and thus terminates SHIFT-CLK signals until the next PCLK pulse starts. Delay 161 is sufficiently long so a maximum number of shifts occurs before the PCLK input arrives at the output. The delayed PCLK signal and the non-delayed PCLK make the output of gate 159 a logic "1" after sufficient delay for shifting and attaining a match condition in the longest case. This logic "1" from gate 159 triggers the playing of a tone generated by the tone synthesis logic 29 (see FIG. 1).

Figure 8:
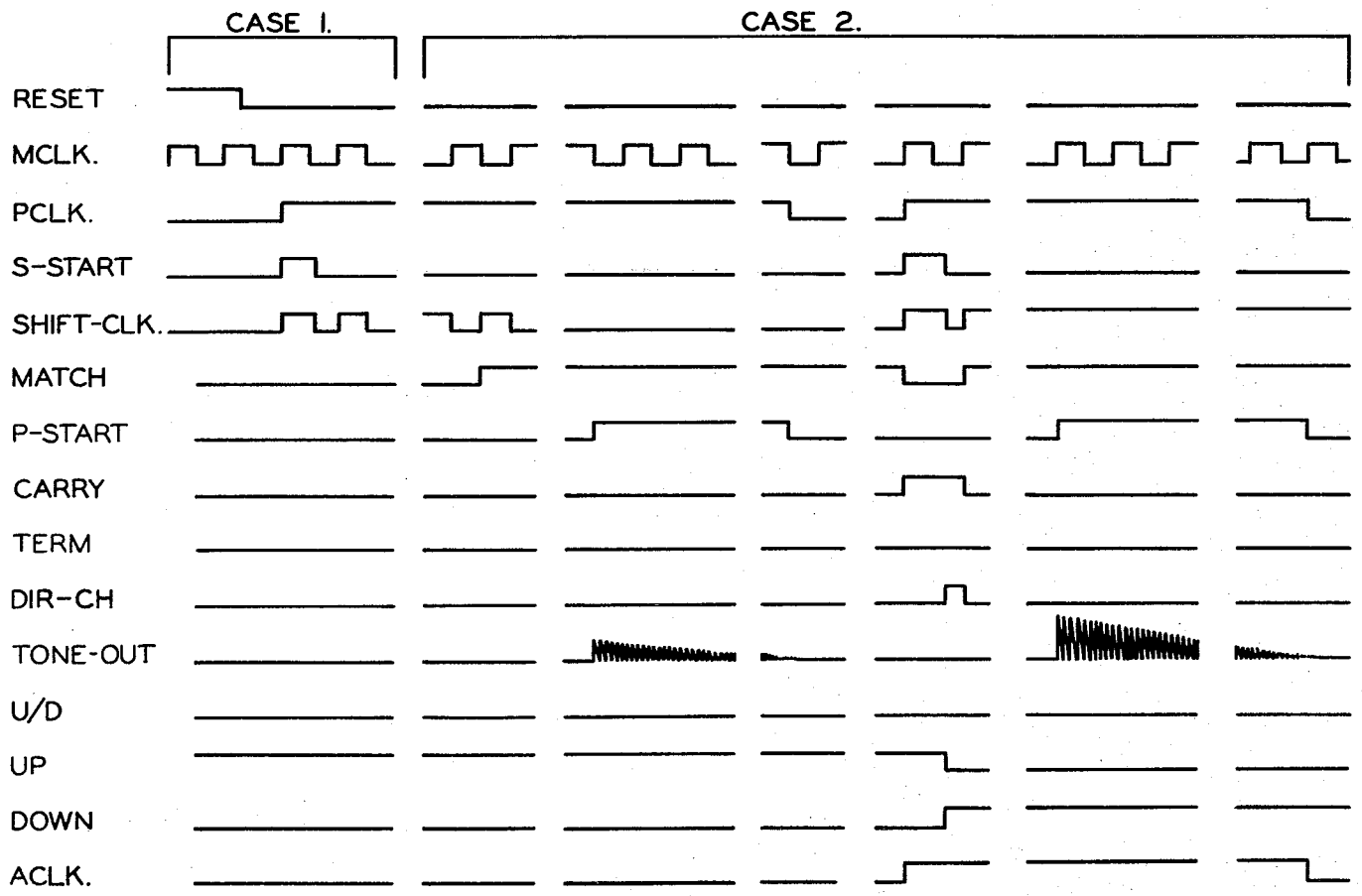
FIG. 8 is a timing diagram for electrical signals generated within the apparatus during its play.

FIG. 8 illustrates the timing relationships of the major signals used in the tone sequence logic (FIG. 4A and FIG. 4B). Case 1 is a scenario starting with a reset condition and, when RESET goes to logic "0", followed by a series of no-match situations. Case 2 is a scenario starting from a no-match condition, going into a match condition with a note played unaccented, then going into a no-match condition with a direction change, and finally going into a match condition with a note played accented.

Figure 5:
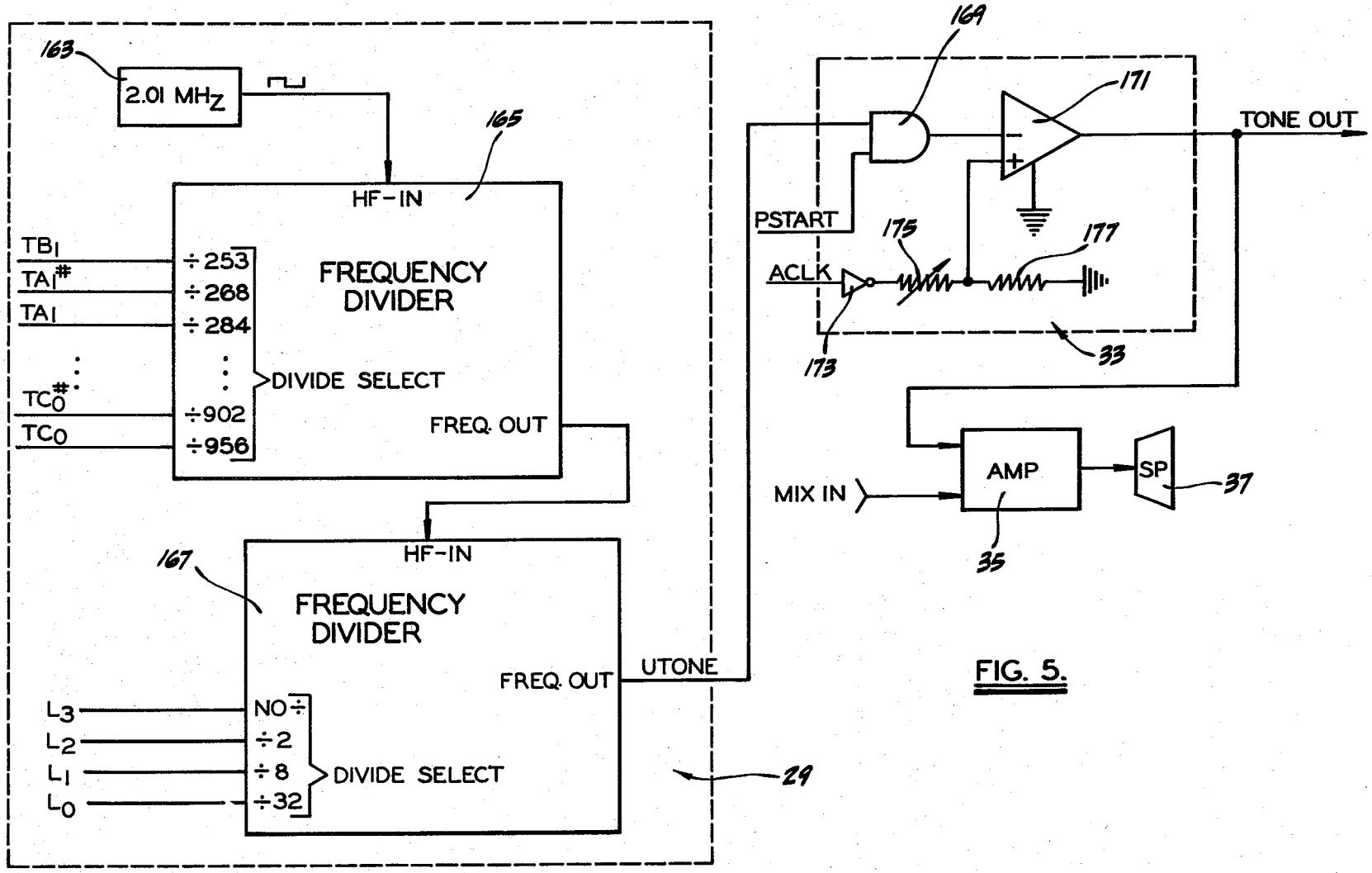
FIG. 5 is a schematic circuit diagram for tone generation circuitry of the apparatus.

FIG. 5. illustrates tone synthesis logic 29, envelope shaping circuitry 33, amplifier 35, and speaker 37. Tone synthesis logic 29 comprises a high-frequency clock 163 connected to frequency divider 165. The outputs of tone scan shift register 111 (FIG. 4B) are connected to the DIVIDE SELECT inputs of frequency divider 165. The signal from clock 163, at the high-frequency input HF-IN of frequency divider 165 is divided according to which DIVIDE SELECT input is on. The FREQ-OUT signal from frequency divider 165 is connected to a second frequency divider 167. The tone range level signals (L0, L1, L2, L3 from FIG. 4A) are connected to the DIVIDE SELECT inputs of circuit 167. The signal at the high-frequency input HF-IN of circuit 167 is divided according to which DIVIDE SELECT input is on. The unshaped output signal UTONE from tone synthesis logic 29 is an unmodulated square wave tone, the tone of which is specified in FIG. 6.

The output of circuit 167 is connected to one input of an AND gate 169 if envelope shaping circuitry 33. The P-START signal (from FIG. 4B) is supplied to the other input of this gate. The unshaped tone signal UTONE is passes to the inverting input of a differential amplifier 171 only when a P-START signal is at logic "1". The ACLK signal (from FIG. 3) is applied to an inverter 173. The output of inverter 173 is connected to a resistor divider circuit comprising resistors 175 and 177. The resistor divider circuit reduces the voltage level of the output of inverter 173. This reduced level is connected to the non-inverting input of amplifier 171 so a logic "0" for the ACLK signal, after inversion and voltage reduction, results in a TONE-OUT signal having a lesser voltage excursion than UTONE. Conversely, when the ACLK signal is logic "1", the TONE-OUT signal has a greater voltage excursion than UTONE to produce an accented note. This amplified difference is shown in case 2 of FIG. 8.

The TONE-OUT signal from amplifier 171 is connected to amplifier 35 and is made available for connection to external devices, such as to the mixing input MIX-IN of other channels of the apparatus. The amplifier 35 may have mixing inputs for receiving TONE-OUT signals from other channels. The output of the amplifier 35 is connected to speaker 37.

Referring to FIG. 2, a front panel of apparatus 1 is shown illustrating the location and number of the various controls, switches, and lamps described hereinabove.

It should be understood that the above electronic design could be implemented using microprocessor technology to obtain the same results.

Apparatus 1 as described is useful both as a music instruction for students as well as a device for composing and playing music for the musically erudite. The illumination of the various lamps as a rhythm pattern is produced or as various tone select switches are scanned will help handicapped persons such as the deaf understand the structure and dynamics of music form and thus enjoy music. As an aid to music composition, the apparatus permits the selection of a wide range of musical sequences such as chords (as formed by multiple channels), arpeggios, scales, trills, and glissandi. In addition, a musician can execute many different and complex musical passages.

What is claimed is:

1. Music playing apparatus for playing selected musical notes in accordance with a selected rhytym pattern comprising:

rhythm means for selecting a rhythm pattern having a multiplicity of intervals, the rhythm means including a circular rhythm scan shift register through which a bit is sequentially shifted to repetitively reproduce a selected rhythm pattern, the rhythm scan shift register having a number of stages corresponding to the number of intervals within the rhythm pattern and the rhythm means further including a set of multiposition switches, each switch representing an interval within the rhythm pattern and each switch having a first switch position designating no note to be played at that interval in the rhythm pattern, a second switch position designating that a note be played at that interval within the rhythm pattern and as an unaccented note, and a third switch position designating that a note be played at that interval within the rhythm pattern and as an accented note;

tone select means for selecting which of a plurality of musical notes is played at each interval within the rhythm pattern;

first tone control means for determining the pitch of a selected note to be played, the pitch of a selected note being within a predetermined band of octaves in the chromatic scale;

second tone control means for selectively extending the number of bands in the chromatic scale within which the note is played; and tone generating means responsive to the rhythm means, the tone select means and the first and second tone control means for generating audible musical tones in accordance with the established rhythm pattern, the selected musical notes and the octave band range within which the selected musical notes are found.

2. Music playing apparatus as set forth in claim 1 further including timing means for generating a variable frequency timing signal the elements of which are supplied to the rhythm scan shift register to shift the bit therethrough, the frequency of the timing signal establishing the tempo with which the selected rhythm pattern is produced.

3. Music playing apparatus as set forth in claim 1 wherein the rhythm means further includes a logic section for producing a first electrical signal indicating that an unaccented note be played at a particular interval within the rhythm pattern and a second electrical signal indicating that an accented note be played for a particular interval within the rhythm pattern.

4. Music playing apparatus as set forth in claim 3 wherein the logic section includes a first set of logic gates one for each interval within the rhythm pattern, each logic gate having as one input a voltage from the output of the corresponding stage of the rhythm scan shift register and as a second input a voltage from the corresponding switch of the set of switches, the voltage applied to a logic gate by its corresponding switch when the switch is set to its second position being such that the gate combines the logic level represented by the voltage from the corresponding stage of the rhythm scan shift register when the bit is shifted to it to produce a voltage the logic level of which indicates that an unaccented note is to be played at this time.

5. Music playing apparatus as set forth in claim 4 wherein the logic section further includes a second set of logic gates one for each interval within the rhythm pattern, each logic gate having as one input a voltage from the output of the corresponding stage of the rhythm scan shift register and as a second input a voltage from the corresponding switch of the set of switches, the voltage applied to a logic gate by its corresponding switch when the switch is set to its third position being such that the gate combines the logic level represented by this voltage with the logic level represented by the voltage from the corresponding stage of the rhythm scan shift register when the bit is shifted to it to produce a voltage the logic level of which indicates that an accented note is to be played at this time.

6. Music playing apparatus as set forth in claim 5 wherein the logic section further includes logic means responsive to a logic level from any logic gate within the first set of logic gates indicating that an unaccented note is to be played to produce an element of the first electrical signal and to a logic level from and logic gate within the second set of logic gates indicating that an accented note is to be played to produce an element of the second electrical signal.

7. Music playing apparatus for playing selected musical notes in accordance with a selected rhythm pattern comprising:

rhythm means for selecting a rhythm pattern having a multiplicity of intervals, the rhythm means including means for repetitively reproducing the rhythm pattern and means for selectively designating whether a note played at any interval within the rhythm pattern is played as an unaccented note or as an accented note;

tone select means for selecting which of a plurality of musical notes is played at each interval within the rhythm pattern, the tone select means including a plurality of switches one for each note within a band of octaves in the chromatic scale and a tone scan shift register having a number of stages equal to the number of tone select switches;

logic means for serially shifting a bit through the tone scan shift register and for loading the bit into one end stage of the tone scan shift register after the bit has been shifted out of the opposite end stage thereof;

means for controlling the directional shift of the bit through the tone scan shift register;

first tone control means for determining the pitch of a selected note to be played, the pitch of the selected note being within a predetermined band of octaves within the chromatic scale, the band of octaves in the chromatic scale in which tones to be played are selected being one of a plurality of bands and the first tone control means including means for selecting the lowest of the plurality of bands selected notes are played in;

second tone control means for selectively extending the number of bands of octaves within the chromatic scale within which a note is played, the second tone control means including means for extending the octave band in which selected notes are played beyond the band of octaves selected by the first tone control means; and, tone generating means responsive to the rhythm means, the tone select means and the first and second tone control means for generating audible musical tones in accordance with the established rhythm pattern, the selected musical notes and the octave band range within which the selected musical notes are found.

8. Music playing apparatus as set forth in claim 7 wherein the shift control means comprises a multiposition switch having a first setting for which the bit is shifted in one direction through the tone scan shift register, a second setting in which the bit is shifted in the opposite direction through the tone scan shift register, and a third setting in which the bit is alternately shifted in the first said direction through the tone scan shift register and then in the opposite direction therethrough.

9. Music playing apparatus as set forth in claim 7 further including a set of logic gates the number of which corresponds to the number of tone select switches, each logic gate having as a first input a voltage applied through its corresponding tone select switch when the switch is closed and as a second input a logic level from the corresponding stage of the tone scan shift register, the voltage represented by the logic level when the bit is shifted through the corresponding stage of the tone scan shift register together with the voltage applied through the corresponding tone select switch causing the logic gate to propagate a signal indicating that a particular note within the predetermined band of octaves is to be played.

10. Music playing apparatus for playing selected musical notes in accordance with a selected rhythm pattern comprising:

rhythm means for selecting a rhythm pattern having a multiplicity of intervals, the rhythm means including means for repetitively reproducing the rhythm pattern and means for selectively designating whether a note played at any interval within the rhythm pattern is played as an unaccented note or as an accented note;

tone select means for selecting which of a plurality of musical notes is played at each interval within the rhythm pattern;

first tone select means for determining the pitch of a selected note to be played, the pitch of a selected note being within a predetermined band of octaves in the chromatic scale, the first tone select means including octave select means for supplying an electrical signal indicating which band of octaves within a range of bands of octaves is the lowest band of octaves in which a selected note is played and a tone range level switch for selecting the lowest band of octaves within the range of bands of octaves in which a selected note is played, the octave select means comprising a set of logic gates, each gate having as one input a logic level determined by the setting of the tone range level switch;

second tone control means for selectively extending the number of bands of octaves in the chromatic scale within which a note is played, the second tone control means including octave shift means for changing the band of octaves in which a note is played from one band of octaves within the range of bands of octaves to another band of octaves therewithin; and tone generating means responsive to the rhythm means, the tone select means and the first and second tone control means for generating audible musical tones in accordance with the established rhythm pattern, the selected musical notes and the octave band range within which the selected musical notes are found, the tone generating means being supplied an electrical signal from the octave select means of the first tone control means.

11. Music playing apparatus as set forth in claim 10 wherein second tone control means includes tone range extension switch for selecting the number of times the lowest band of octaves will be shifted from one band of octaves within the range of bands of octaves to another band of octaves therewithin and thereby the extent of the octave band range within which selected notes are played.

12. Music playing apparatus as set forth in claim 11 wherein the second tone control means further includes a tone range shift register the contents of which are partially determined by the setting of the tone range level switch.

13. Music playing apparatus as set forth in claim 12 wherein the logic output of the tone range shift register is supplied as a second input to the set of logic gates and the second tone control means further includes shift logic means for shifting the contents of the tone range shift register.

14. Music playing apparatus as set forth in claim 13 wherein the tone select means includes a tone scan shift register through which a bit is serially shifted and the shift logic means includes means responsive to the shifting of the bit out of the tone scan shift register to shift the contents of the tone range shift register thereby to change the logic output of the tone range shift register supplied to the set of logic gates, changing of the logic output supplied to the set of logic gates resulting in a change in the content of the electrical signal supplied to the tone generating means and a shift in the lowest band of octaves in the octave band range in which a selected note is played.

* * * * *